United States Patent [19]

Rosenberg

[11] Patent Number: 4,590,689

[45] Date of Patent: May 27, 1986

[54] AIR-TRAPPING INSOLES

[75] Inventor: David Rosenberg, New York, N.Y.

[73] Assignee: Vynalam, Ltd., New York, N.Y.

[21] Appl. No.: 645,681

[22] Filed: Aug. 30, 1984

[51] Int. Cl.[4] ..... A43B 7/06

[52] U.S. Cl. ..... 36/3 B; 36/44

[58] Field of Search ..... 36/44, 3 B, 43, 3 R, 36/29

[56] References Cited

U.S. PATENT DOCUMENTS

| | | | |
|---|---|---|---|
| 2,713,214 | 7/1955 | Gulaskie | 36/44 |
| 2,917,844 | 12/1959 | Scholl | 36/44 X |
| 3,457,659 | 7/1969 | Coleman | 36/44 |
| 3,716,930 | 2/1973 | Brahm | 36/3 B |
| 3,785,069 | 1/1974 | Brown | 36/44 |
| 4,123,855 | 11/1978 | Thedford | 36/44 |
| 4,192,086 | 3/1980 | Sichak | 36/44 |
| 4,215,492 | 8/1980 | Sandmeier | 36/44 |
| 4,224,746 | 9/1980 | Kim | 36/44 X |
| 4,336,661 | 1/1982 | Medrano | 36/3 B X |

*Primary Examiner*—Werner H. Schroeder
*Assistant Examiner*—T. Graveline
*Attorney, Agent, or Firm*—Lewis H. Eslinger

[57] ABSTRACT

A cushion-like, shock-absorbent insole for footwear comprises two vinyl sheets forming an airtight compartment and sealing therein one or more sheets of resilient foam. Vent holes arranged in at least one of the vinyl sheets, preferably at the heel and metatarsal areas, act as metering valves in conjunction with the inside surface of the shoe sole so that air trapped in the foam material cannot instantaneously escape and both cushioning and massaging are provided.

16 Claims, 6 Drawing Figures

AIR-TRAPPING INSOLES

BACKGROUND OF THE INVENTION

1. Field of the Invention

The present invention relates to a shoe and, more particularly to an air-trapping, massaging and cushioning insole having a foam interior.

2. Description of the Prior Art

Insoles, whether made from latex foam, synthetic or natural rubber, or other materials are from $\frac{1}{8}$ to 3/16 inches thick, and are die cut with a larger number of vent holes. Although these insoles are designed to cushion the user's feet, the weight and pressure from standing or walking on die-cut insoles usually compresses the insole to approximately 50% its original thickness. This forces all of the air from the insole and virtually eliminates the cushioning value of the material used. Thus, most of the resiliency and cushioning qualities of the die-cut insoles cannot be utilized by the wearer. These insoles also do not massage the user's feet. Furthermore, prior art insoles are not adaptable to satisfy the very different cushioning needs of both sedentary and of active persons.

SUMMARY OF THE INVENTION

Accordingly, it is an object of the present invention to overcome the aforementioned disadvantages inherent in the prior are insoles.

It is another object of the present invention to provide an insole that retains its cushioning properties, even when pressure is applied, and further provides a foot massaging action.

In accordance with an aspect of the present invention, an insole for footwear capable of massaging and cushioning the foot comprises top and bottom sheets forming a compartment and sealing therein a resilient foam material. Air vents are formed in the bottom sheet and cooperate with the inside surface of the shoe sole to meter the expulsion of the air trapped in the resilient foam, thereby providing increased cushioning.

These and other features, objects and advantages of the present invention will be apparent from the following detailed description of preferred embodiments of the invention when considered with the drawings.

DETAILED DESCRIPTION OF PREFERRED EMBODIMENTS

Figure 1:
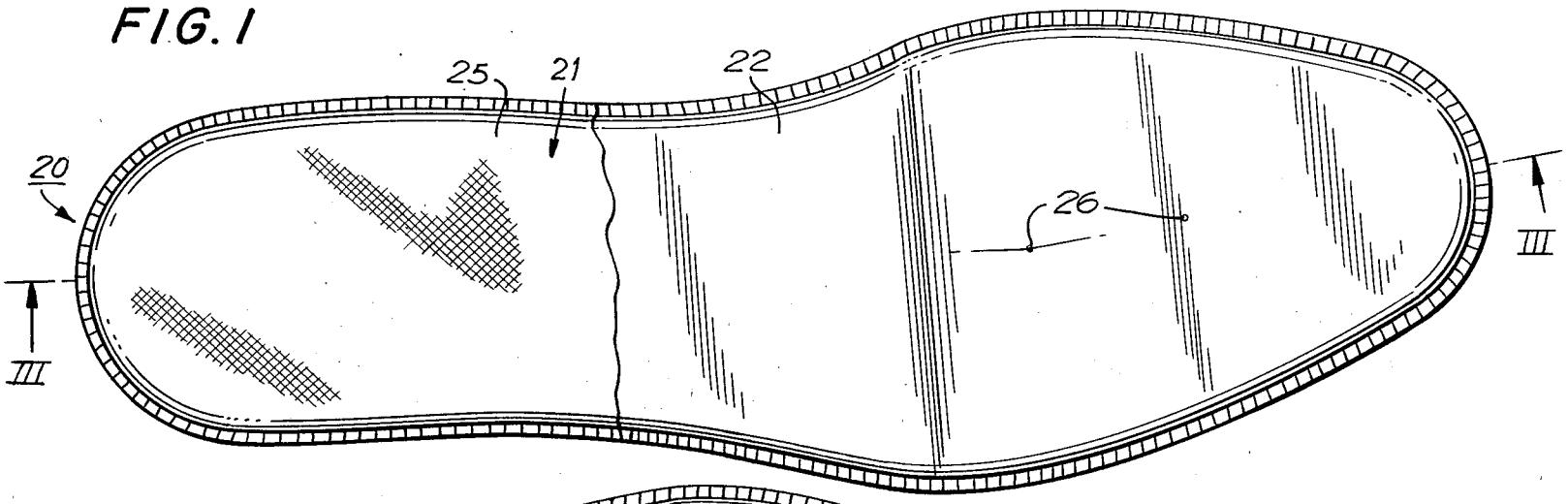
FIG. 1 is a top plan view (partially broken away) of an embodiment of an insole according to the present invention.
Figure 2:
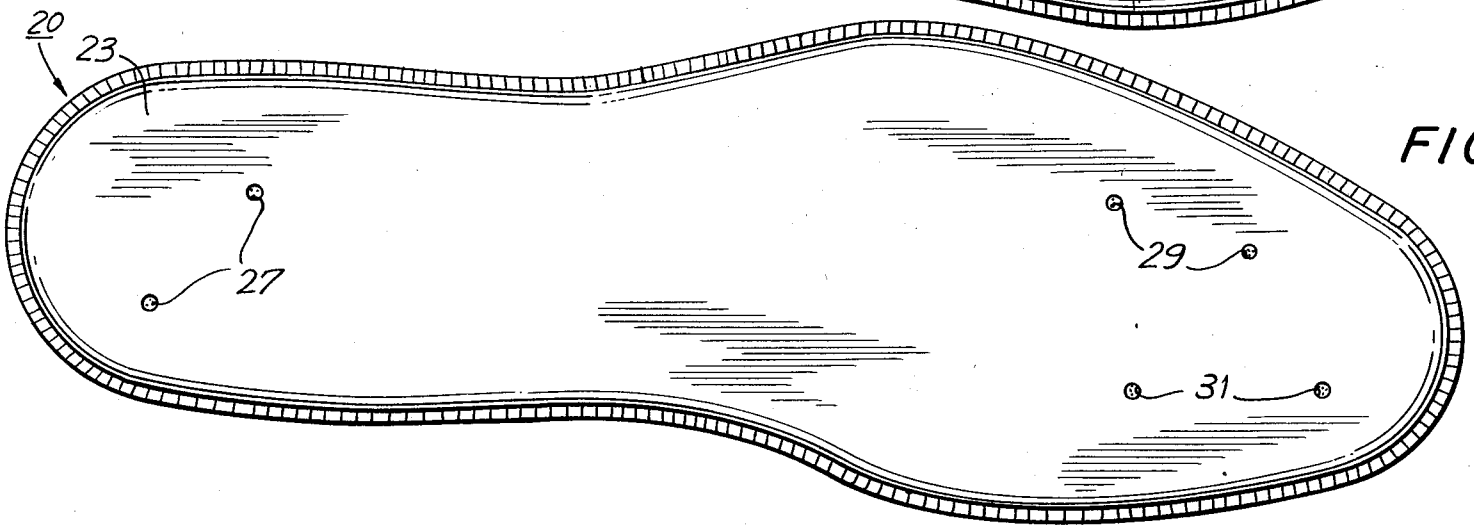
FIG. 2 is a bottom plan view of the insole of FIG. 1.
Figure 3:
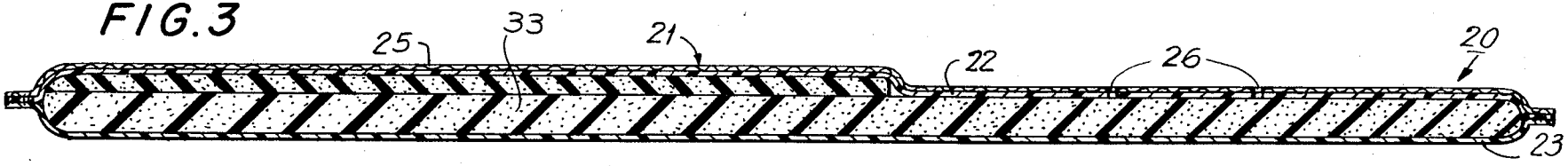
FIG. 3 is a cross-sectional elevation view taken through section lines III—III in FIG. 1.

FIGS. 1, 2, and 3 show an insole in accordance with an embodiment of the present invention, in which the insole 20 comprises top sheet 21 and bottom sheet 23, which are electronically welded together at the edges so that the welded continuous seam is airtight. The bottom sheet 23 is a thin layer of a vinyl material that has a flexible, soft hand and that readily conforms to the contours of the foot and the shoe. The top sheet 21 is formed of a thin sheet 22 of similar vinyl material that has a fine backing cloth 25 laminated thereto for absorbing perspiration. The top sheet 21 includes two pin holes 26 located in the metatarsal area, and bottom sheet 23 includes three pairs of air vents 27, 29 and 31, which are larger in diameter relative to pin holes 26. Air vents 27 are located in the heel area, and air vents 29 and 31 are located in the metatarsal area. Pin holes 26 and air vents 27, 29, and 31, to be discussed in greater detail below, permit air to be drawn into and expelled from insole 20.

The resilient foam member, shown at 33 in FIG. 3, substantially fills the space between top layer 21 and bottom layer 23 of insole 20 and is sealed within this compartment formed by the top and bottom sheets 21 and 23. In this embodiment, resilient foam member 33 includes two layers of resilient foam in the heel and arch area of the foot and one layer of resilient foam in the vamp area. The single layer of foam member 33 tapers down in thickness toward the vamp area where space within the shoe is more limited. Any number of layers of resilient foam may be used in any area of the shoe. The foam 33 is selected to have excellent cushioning, shock absorbing qualities, and suitable tensile strength. Foams of medium to high density with excellent memory and resiliency such as polyurethane, latex, synthetic rubber, and vinyl foam produce optimal results. The height of a single foam layer may vary from $\frac{1}{8}$–$\frac{1}{2}$ inches with a preferred height of 3/16–$\frac{1}{4}$ inches, in order to fit comfortably within a user's shoe.

In operation, insole 20 cushions the user's foot and, unlike die-cut insoles that are compressed to approximately 50% their original height when a user stands on them, which causes them to lose their cushioning capability, the cushioning capability of insole 20 is substantially unaffected by the user's weight and the pressure of walking. When a user stands on insole 20, air vents 27, 29, and 31 are sealed by the downward pressure forcing layer 23 against the inner surface of the shoe sole, and air trapped within the airtight compartment containing the foam member 33 prevents the user's weight and pressure from compressing resilient foam member 33. This foam member 33 thereby fully cushions the user's foot during walking or standing.

Another feature of the present invention is that when a user walks, jogs and so forth insole 20 not only cushions but also massages the user's foot. When a user walks, he or she typically places a foot on the ground heel first, followed by the ball or metatarsal area of the foot. Placing the heel on the ground seals air vents 27 against the inner surface of the shoe sole, but leaves air vents 29 and 31 uncovered. The weight and pressure of the user's heel will compress the resilient foam member 33 in the heel area and cause the air to move through insole 20 along the arch of the foot, massaging the foot, and to attempt to escape through air vents 29 and 31. The user then places the metatarsal area of the foot on the ground and seals air vents 29 and 31 against the inner surface of the shoe sole. As the user then lifts his of her heel, the resilient foam piece 33 in the heel area expands and is re-inflated.

The number, diameter and placement of the air vents 27, 29, and 31 is important because the air vents 27, 29 and 31 affect both the volume and pressure of the air within the insole 20. In this embodiment the air vents have a diameter of approximately ⅛ of an inch. Fewer air vents, with smaller diameters, permit the insoles 20 to retain a greater amount of air, thereby affording a greater degree of cushioning and massaging. More air vents, with larger diameters, decrease the cushioning and massaging action but increase air ventilation. In addition, placing the air vents in the bottom sheet only, results in the greatest amount of massaging action. The two pin holes 26 disposed in the metatarsal area of top sheet 21 serve to cool the ball of the foot as the air exits pin holes 26, without detracting from the massaging action.

A further advantage of the present invention is that the continual air movement serves to keep the feet cool and dry in the summer and warm in the winter because air is an insulator. This is a particular advantage for people with poor circulation, as simply walking will now warm their feet.

Figure 4:
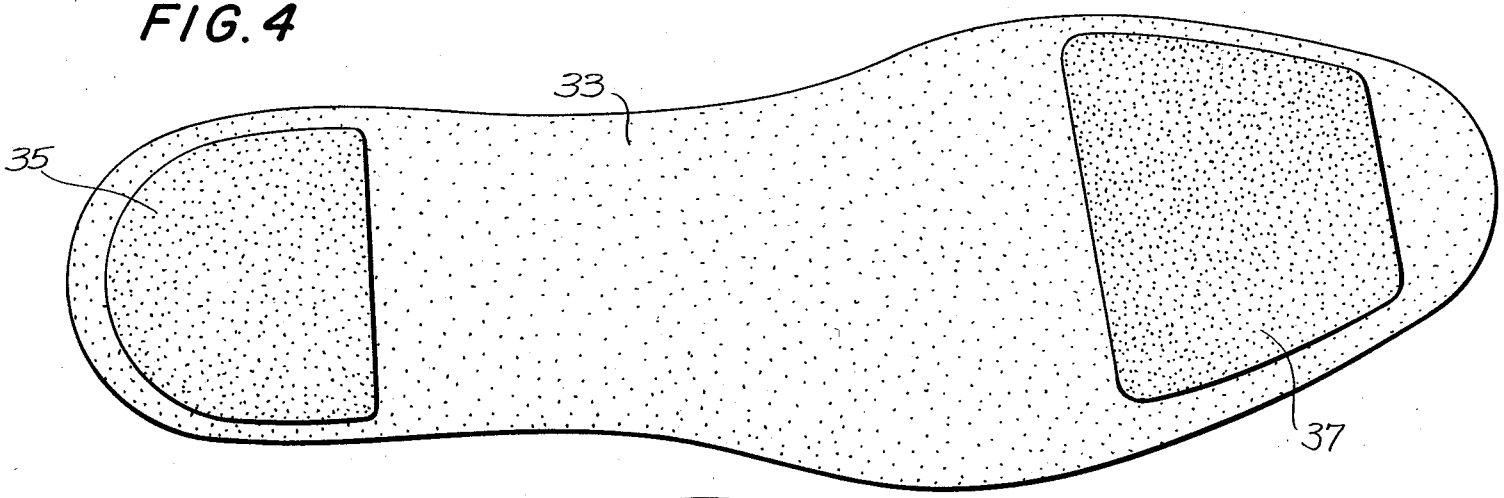
FIG. 4 is a top plan view of the interior foam layer of the insole, showing additional foam pieces at the heel and metatarsal area.

FIG. 4 depicts another embodiment of the present invention, wherein a separate resilient foam heel piece 35 is placed in the heel area, and a separate resilient foam metatarsal piece 37 is placed in the metatarsal area. These additional foam pieces 35 and 37 further cushion the two critical foot areas where the most weight and pressure are applied. They also serve to increase the massaging action by increasing pumping action, because more foam is compressed in both the heel and metatarsal area as a user walks, jogs and so forth, resulting in more air movement within insole 20, and hence, more massaging action.

Figure 5:
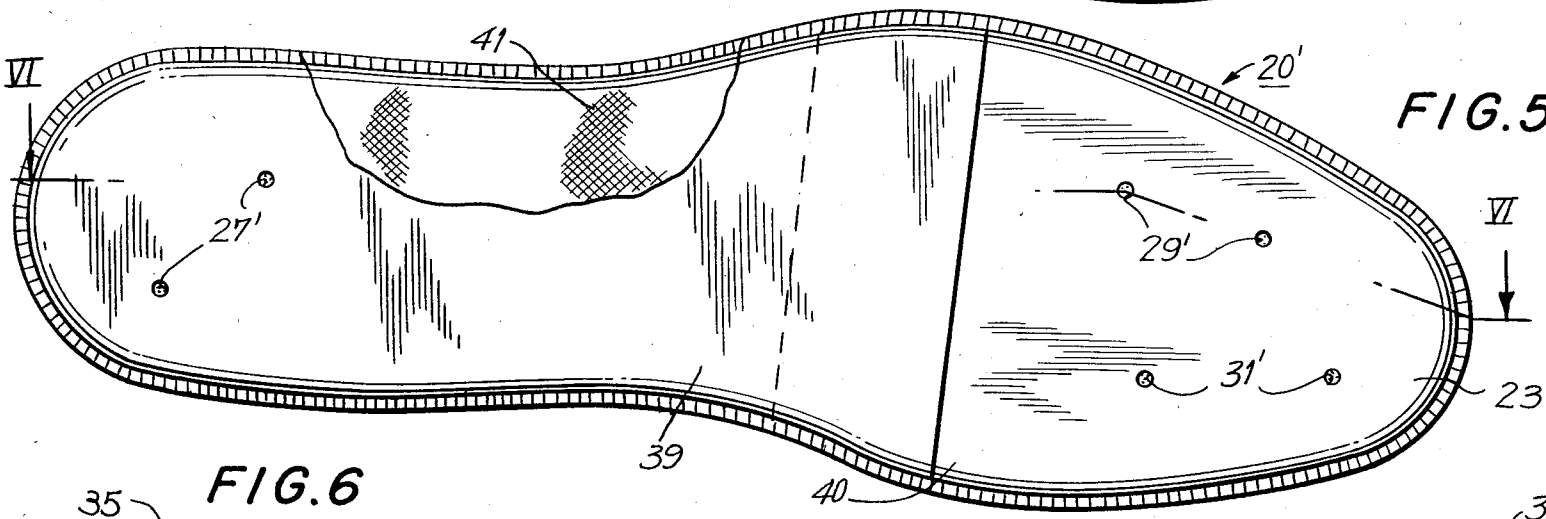
FIG. 5 is a bottom plan view of another embodiment of the present invention featuring a transverse slit.
Figure 6:
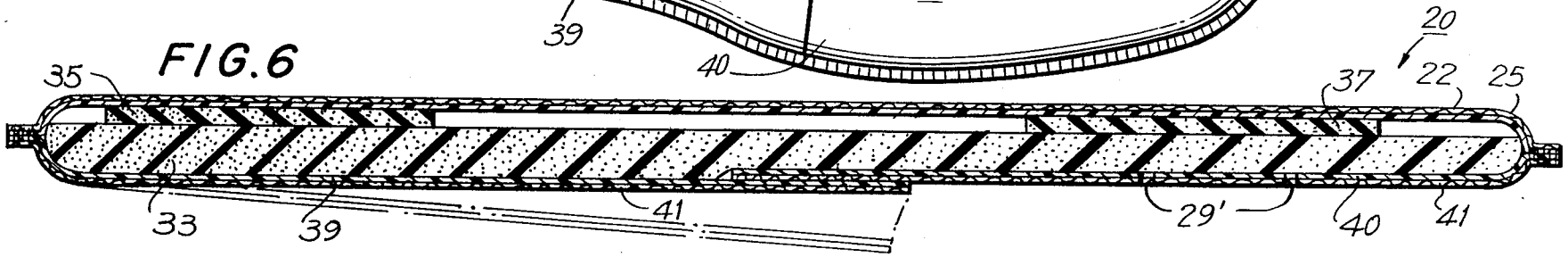
FIG. 6 is a cross-sectional view taken along the lines VI—VI of FIG. 5.

FIGS. 5 and 6 shown an alternate embodiment of the present invention wherein the bottom sheet 23' is formed of two separate segments 39, 40 that overlap at their adjacent edges. Thus, the insole 20' additionally functions as a removable slipcover for the interior foam. A user may slip additional foam or die-cut insoles, into the compartment to increase the cushioning value of the die cut insole, which previously was unable to trap air. A user may also insert and remove additional heel piece 35, metatarsal piece 37, or layers of the resilient foam member 33, thereby monitoring the degree of cushioning and massage. The overlap between segments 39, 40 is chosen so that when the insole is in use the weight of the user will cause the two segments 30, 40 to be in sealing engagement, thereby forming the desired airtight compartment.

A fine backing cloth 41, such as a knitting cloth composed of approximate equal parts of cotton and Tetron or similar synthetic fiber, that is cool to the touch and absorbs perspiration, is also laminated to the bottom sheet 23'. Thus, the insole 20' is reversible, as the top sheet 21' of the insole 20' for the left foot, may function as the bottom sheet 23' of the insole 20' for the right foot, and vice versa.

Another feature of the present invention is that the insole may be manufactured to accommodate the different respective cushioning and massaging needs of sedentary and active persons. Sedentary persons require insoles with less cushioning and more air ventilation. Therefore, insoles that include a greater number of air vents of larger diameter, situated on both top and bottom sheets, accommodate these particular needs. Active persons, on the other hand, require insoles with maximum shock absorbing capability and greater massaging action. Thus, insoles having a fewer number of air vents, of smaller diameter, located primarily on the bottom sheet and especially in the metatarsal area fulfill these particular needs. The insoles for active people may also have pin holes located on the top sheet in the metatarsal area to cool the ball of the foot without detracting from the massaging action. To achieve the greater degree of cushioning with shock absorbing qualities, a denser foam also may be used.

The resilient foam member 33, foam heel piece 35 and foam metatarsal piece 37 may be treated with chemicals such as activated charcoal and anti-bacterial agent, to combat odors and fungus. In addition, the vinyl and cloth top sheet 21 and bottom sheet 23 are washable.

It will also be appreciated that decreasing the percentage of plasticizer used when manufacturing the vinyl sheets 21 and 23 will prevent wrinkling of the vinyl after lengthy use. The vinyl may also be manufactured with an anti-fungus compound.

One skilled in the art will realize, of course, that the air vents may be of any diameter and number, and may be placed in any area of the insole to achieve the desired degree of cushioning and massaging action. Nevertheless, when disposing air vents on both top and bottom sheets, it is undesirable to place them directly opposite each other.

In addition because these insoles are intended to be inserted into the footwear after purchase, the life of the footwear is extended when an insole is inserted because the insides can then withstand greater wear and tear. The insoles may also be designed as part of the original footwear unit, in which case they may be incorporated beneath the inner lining in the sole area of the footwear.

Although specific embodiments of the present invention have been described in detail herein with reference to the accompanying drawings, it is to be understood that the invention is not limited to those embodiments, and that various changes and modifications can be affected therein by one skilled in the art without departing from the scope or spirit of the invention as defined in the appended claims.

What is claimed is:

1. An insole for use inside footwear between the inner surface of the footwear sole and the bottom of a wearer's foot, comprising:

a first resilient sheet having a shape substantially identical to said inner surface of said sole;

a second resilient having a shape identical to said first resilient sheet and being attached together around the respective perimeters with an airtight seal to form a compartment therebetween;

a resilient foam member arranged within said compartment; and at least one air vent formed in at least one of said first and second sheets for permitting air to enter and to exit said compartment, thereby drawing air into said compartment and expelling said air when said insole is used by a person in locomotion;

wherein at least one of said first and second resilient sheets further includes a slit for permitting the insertion or removal of said resilient foam member in said compartment, and said slit is comprised of adjacent, overlapping edges for forming an airtight seal upon mutual engagement under weight of the wearer.

2. An insole as in claim 1; wherein said resilient foam member is formed of urethane foam material.

3. An insole as in claim 1; wherein said resilient foam member is formed as one layer of resilient foam.

4. An insole as in claim 3; further comprising at least one additional layer of resilient foam at the area corresponding to the metatarsel area of the wearer's foot for permitting further massaging and cushioning of the foot.

5. An insole as in claim 3; further comprising at least one additional layer of resilient foam at the area corresponding to the wearer's heel for providing further massaging and cushioning of the foot thereat.

6. An insole as in claim 3; wherein said at least one air vent is disposed in said bottom such that said bottom sheet includes two vents disposed in the area corresponding to the wearer's heel and four vents disposed in the area corresponding to the wearer's metatarsal area.

7. An insole as in claim 6; wherein said at least one air vent is disposed in said top sheet such that said top sheet includes at least one pin hole disposed in the area corresponding to the wearer's metatarsal area for cooling the ball of the foot.

8. An insole as in claim 3, wherein said layer of resilient foam is between $\frac{1}{8}$ to $\frac{1}{2}$ inches in thickness.

9. An insole as in claim 1; wherein said resilient foam member is formed of at least two layers of resilient foam in the areas corresponding to the heel and arch of the wearer's foot, and at least one layer of resilient foam in the area cooresponding to the vamp of the footwear.

10. An insole as in claim 1; wherein said at least one air vent is located in the area corresponding to the wearer's heel.

11. An insole as in claim 1; wherein said at least one air vent is located in the area corresponding to the wearer's metatarsal area.

12. An insole as in claim 1; further comprising a backing cloth attached to at least one of said first and second resilient sheets for absorbing perspiration, wherein said backing cloth has been chemically treated for preventing odors and fungus.

13. An insole as in claim 1; wherein said first and second resilient sheets are impervious to liquids.

14. An insole as in claim 13; wherein said sheets are composed of a vinyl compound.

15. An insole for use inside footwear between the inner surface of the footwear sole and the bottom of a wearer's foot, comprising:

a first resilient sheet having a shape substantially identical to said inner surface of said sole;

a second resilient sheet having a shape identical to said first resilient sheet and being attached together around the respective perimeters with an airtight seal to form a compartment therebetween;

a resilient foam member arranged within said compartment;

at least one air vent formed in at least one of said first and second sheets for permitting air to enter and to exit said compartment, thereby drawing air into said compartment, and expelling said air when said insole is used by a wearer in locomotion;

said insole further comprising backing cloth attached to said first and second resilient sheets for absorbing perspiration; in which said second resilient sheet is adapted to be a bottom sheet in juxtaposition with said inner surface of the sole and said at least one air vent comprises two air vents located in the area corresponding to the wearer's heel and four air vents located in the area corresponding to the wearer's metatarsal area; said first sheet is adapted to be a top sheet relative to said second sheet and said at least one air vent and further comprising two pin holes in the area corresponding to the metatarsal for permitting massaging of the ball of the foot, said pin holes having a diameter less than said air vents; said resilient foam member includes two layers of resilient foam in the areas corresponding to the wearer's heel and arch, and one layer of resilient foam in the vamp area of the footwear; each of said layers of resilient foam being approximately 3/16 inches thick; said first and second resilient sheets incuding chemical means for preventing odors and fungus; and said first and second resilient sheets being formed of a material that is impervious to liquids.

16. An insole as in claim 15; wherein said top sheet includes two air vents in the metatarsal area for increasing ventilation.

* * * * *